US009922544B2

(12) United States Patent
Gallagher et al.

(10) Patent No.: US 9,922,544 B2
(45) Date of Patent: Mar. 20, 2018

(54) GLASS BREAKAGE DETECTION SYSTEM

(71) Applicant: Microsemi Semiconductor (U.S.) Inc., Austin, TX (US)

(72) Inventors: Michael C Gallagher, Langhorne, PA (US); Jim Van Buskirk, Austin, TX (US); Ivan Acosta, Austin, TX (US); Eric Bass, Austin, TX (US); Dean Morgan, Kanata (CA)

(73) Assignee: Microsemi Semiconductor (U.S.) Inc., Austin, TX (US)

( * ) Notice: Subject to any disclaimer, the term of this patent is extended or adjusted under 35 U.S.C. 154(b) by 0 days.

(21) Appl. No.: 15/479,302

(22) Filed: Apr. 5, 2017

(65) Prior Publication Data

US 2017/0309161 A1 Oct. 26, 2017

Related U.S. Application Data

(60) Provisional application No. 62/325,233, filed on Apr. 20, 2016.

(51) Int. Cl.

| | |
|---|---|
| ***G08B 13/18*** | (2006.01) |
| ***G08B 29/18*** | (2006.01) |
| ***G08B 13/16*** | (2006.01) |
| ***G08B 13/04*** | (2006.01) |

(52) U.S. Cl.

CPC ..... *G08B 29/185* (2013.01); *G08B 13/04* (2013.01); *G08B 13/1672* (2013.01)

(58) Field of Classification Search

CPC ... G08B 13/04; G08B 13/1672; G08B 29/185
USPC ..... 340/552, 522, 511, 426.23, 426.27, 550, 340/566, 541, 693.12
See application file for complete search history.

(56) References Cited

U.S. PATENT DOCUMENTS

| | | | | |
|---|---|---|---|---|
| 4,134,109 A | | 1/1979 | McCormick et al. | |
| 5,831,528 A | * | 11/1998 | Cecic | G08B 13/04 340/522 |
| 6,538,570 B1 | * | 3/2003 | Smith | G08B 13/04 340/550 |

(Continued)

FOREIGN PATENT DOCUMENTS

WO 2006/052023 A1 5/2006

OTHER PUBLICATIONS

Communication Relating to the Results of the Partial International Search for parallel application PCT/US2017/026036 mailed by the European Patent Office dated Jul. 14, 2017.

(Continued)

*Primary Examiner* — Tai T Nguyen
(74) *Attorney, Agent, or Firm* — Simon Kahn

(57) ABSTRACT

A glass breakage detection method, constituted of: receiving a plurality of audio samples; estimating low frequency power values of the received plurality of audio samples; estimating wide band power values of the received plurality of audio samples; responsive to the estimated wide band power values, determining an amplification value; responsive to the estimated low frequency power being greater than a predetermined threshold, amplifying a function of the received plurality of audio samples by the determined amplification value; comparing the amplified function with a predetermined function of sound of breaking glass; and outputting an indication of the comparison.

8 Claims, 9 Drawing Sheets

(56) References Cited

U.S. PATENT DOCUMENTS

| | | | | |
|---|---|---|---|---|
| 7,680,283 | B2 * | 3/2010 | Eskildsen | G08B 13/1672 340/541 |
| 9,384,641 | B2 * | 7/2016 | Zhevelev | G08B 13/1672 |

OTHER PUBLICATIONS

Provisional Opinion Accompanying the Partial Search Result for parallel application PCT/US2017/026036 mailed by the European Patent Office dated Jul. 14, 2017.

* cited by examiner

GLASS BREAKAGE DETECTION SYSTEM

BACKGROUND OF THE INVENTION

Glass breaking audio detection has been implemented using energy detection techniques where the energy pattern is monitored over time. A typical glass breaking signal will consist of an impulse plus an exponentially decreasing tail. Prior art glass breaking detection systems range from simple acoustic energy detectors to frequency counters, to more sophisticated spectral analysis algorithms, however these systems generally suffer from a significant number of false positives.

What is desired, and not provided by the prior art, is a glass breakage detection system which reduces the number of false positives while increasing the probability of detecting breakage of glass.

SUMMARY OF THE INVENTION

Accordingly, it is a principal object of the present invention to overcome at least some of the disadvantages of the prior art. In one embodiment a glass breakage detection method is enabled, the method comprising: receiving a plurality of audio samples; estimating low frequency power values of the received plurality of audio samples; estimating wide band power values of the received plurality of audio samples; responsive to the estimated wide band power values, determining an amplification value; responsive to the estimated low frequency power being greater than a predetermined threshold, amplifying a function of the received plurality of audio samples by the amplification value; comparing the amplified function with a predetermined function of sound of breaking glass; and outputting an indication of the comparison.

In one embodiment, the method further comprises determining Mel-spaced band power values of the received plurality of audio samples, wherein low frequency power value estimation is responsive to the determined Mel-spaced band power values. In another embodiment, plurality of audio samples are received over a predetermined time period, wherein the method further comprises comparing the estimated low frequency power values of each of a plurality of portions of the predetermined time period with a predetermined threshold, and wherein the amplification is responsive to estimated low frequency power values being greater than the predetermined threshold for more than one of the plurality of time period portions.

Independently, the embodiments provide for an alarm system, comprising: an input module arranged to: receive audio data; and sample the received audio data at a predetermined sampling rate to produce a plurality of audio samples, an impact detection module arranged to receive an output of the input module, the impact detection module arranged to: estimate low frequency power values of the received plurality of audio samples; estimate wide band power values of the received plurality of audio samples; determine, responsive to the estimated wide band power values, an amplification value for the gain module; and assert, responsive to the estimated low frequency power being greater than a predetermined threshold, an impact detection signal, a gain module, responsive to an output of the impact detection module and to the impact detection signal, the gain module arranged to receive the output of the input module and arranged to amplify a function of the received plurality of audio samples by the determined amplification value in the event that the impact detection signal has been asserted; a glass breakage detection module responsive to an output of the gain module, the glass breakage detection module arranged to compare the amplified function of the received plurality of audio samples with a predetermined function of sound of breaking glass; and an output module responsive to the glass breakage detection module arranged to output an indication of the comparison.

In one embodiment, the impact detection module is further arranged to determine Mel-spaced band power values of the received plurality of audio samples, the low frequency power value estimation responsive to the determined Mel-spaced band power values. In another embodiment the plurality of audio samples are received over a predetermined time period and wherein the impact detection module is further arranged to: compare the estimated low frequency power values of each of a plurality of portions of the predetermined time period with a predetermined threshold; and wherein the assertion of the impact detection signal amplification is responsive to the compare estimated low frequency power values being greater than the predetermined threshold for more than one of the plurality of time period portions.

Independently, the embodiments herein provide for a multi-purpose alarm system, comprising: an input module arranged to receive audio samples; a T3/T4 detection module arranged to detect sounds of a T3 or T4 alarm within the received audio samples; a glass breakage detection module arranged to detect sounds of breaking glass within the received audio samples; a programmable sound energy detection module arranged to detect various predetermined sounds within the received audio samples; and a voice communication module arranged to provide two way communication between a communication device and a communication network, wherein each of the T3/T4 detection module, the glass breakage detection module and the programmable sound energy detection module comprise a unique amplifier arranged to amplify the received audio samples by a predetermined respective gain.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
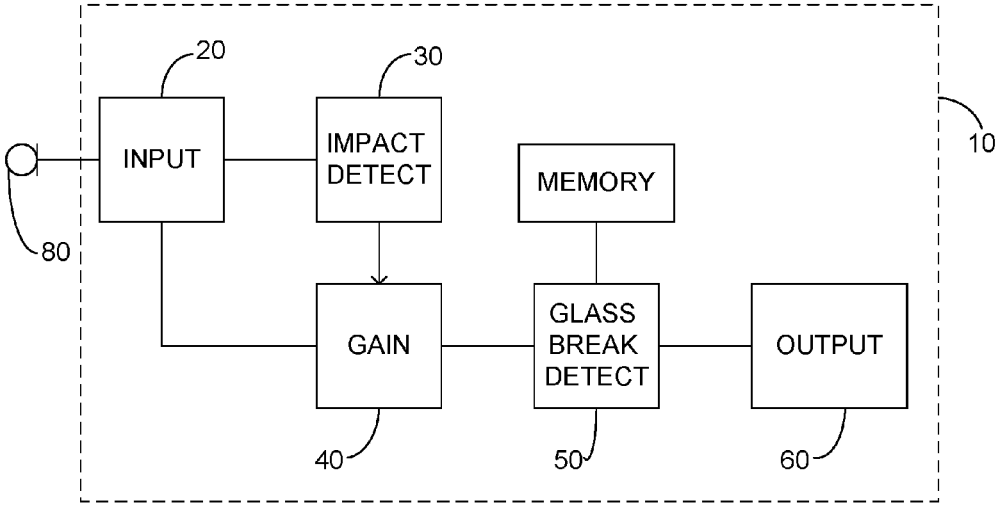
FIG. 1 illustrates a high level block diagram of an embodiment of a glass breakage detection system.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The terms "connected" or "coupled", or any variant thereof, as used herein is not meant to be limited to a direct connection, and is meant to include any coupling or connection, either direct or indirect, and the use of appropriate resistors, capacitors, inductors and other active and non-active elements does not exceed the scope thereof.

FIG. 1 illustrates a high level block diagram of a glass breakage detection system 10. Glass breakage detection system 10 comprises: an input module 20; an impact detection module 30; a gain module 40; a glass breakage detection module 50; and an output module 60. Each of input module 20, impact detection module 30, gain module 40, glass breakage detection module 50 and output module 60 may be implemented in application specific hardware, or in software run on the appropriate processor, with instructions stored in a computer readable memory 70.

The output of input module 20 is fed to impact detection module 30 and to gain module 40. The output of impact detection module 30 is fed to a control input of gain module 40. The output of gain module 40 and an output of memory are each fed to respective inputs of glass breakage detection module 50. The output of glass breakage detection module 50 is fed to output module 60.

Input module 20 is in electrical communication with a microphone 80 and is arranged to receive audio data therefrom. Input module 20 digitally samples the received audio data from microphone 80 at a predetermined sampling rate and outputs the sampled audio data to both impact detection module 30 and gain module 40.

As will be described below, impact detection module 30 is arranged to analyze the audio data to determine whether a low frequency impact sound has been received at microphone 80. A low frequency impact sound indicates that an object has impacted glass, thereby increasing the probability that sounds of breaking glass will be detected at microphone 80. In the event that impact detection module 30 detects a low frequency impact sound, a signal is output to gain module 40. Responsive to the received signal, gain module 40 is arranged to amplify a predetermined portion of the audio data of input module 20, the amplified portion received by glass breakage detection module 50. In one embodiment, the predetermined audio data portion is 1.6 seconds of audio data. As will be described below, glass breakage detection module 50 is arranged to compare a function of the amplified audio portion with functions of known sounds of glass breaking stored on memory 70. Responsive to the comparison, glass breakage detection module 50 is arranged to determine whether the sounds received at microphone 80 include sounds of breaking glass, the determination output by output module 60 to an external network and/or to an alarm system.

Figure 2A:
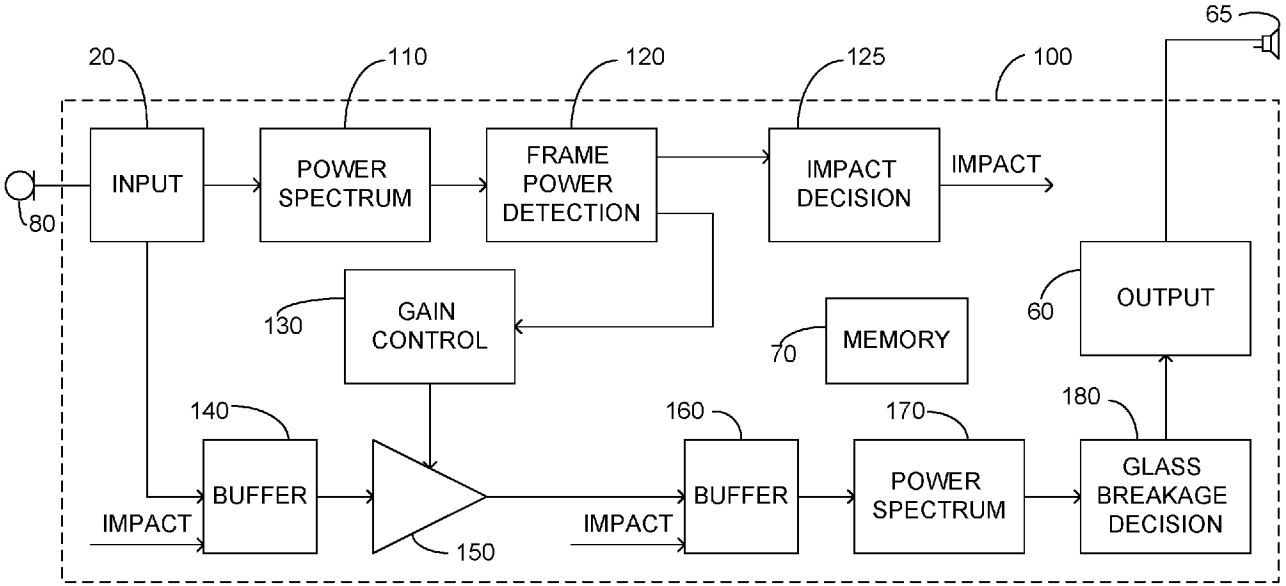
FIG. 2A illustrates a high level block diagram of a more detailed embodiment of a glass breakage detection system.

FIG. 2A illustrates a high level block diagram of a glass breakage detection system 100 and FIGS. 2B-2E illustrate non-limiting embodiments of various components of glass breakage detection system 100, FIGS. 2A-2F being described together. Glass breakage detection system 100 comprises: an input module 20; a power spectrum module 110; a frame power detection module 120; an impact decision module 125; a gain control 130; a buffer 140; an amplifier 150; a buffer 160; a power spectrum module 170; a glass breakage decision module 180; a memory 70; and an output module 60. Each of input module 20, power spectrum module 110, frame power detection module 120, impact decision module 125, gain control 130, buffer 140, amplifier 150, buffer 160, power spectrum module 170 and glass breakage decision module 180 may be implemented in application specific hardware, or in software run on the appropriate processor, with instructions stored in memory 70. In one embodiment, buffer 140 comprises a circular buffer.

The output of input module 20 is fed to power spectrum module 110 and to buffer 140. The output of power spectrum module 110 is fed to frame power detection module 120. The output of frame power detection module 120 is fed to impact decision module 125 and to gain control 130. The output of impact decision module 125 is fed to buffers 140 and 160. The output of gain control 130 is fed to a control input of amplifier 150. The output of buffer 140 is fed to amplifier 150 and the output of amplifier 150 is fed to buffer 160. The output of buffer 160 is fed to power spectrum module 170 and the output of power spectrum module 170 is fed to a first input of glass breakage decision module 180. A second input of glass breakage decision module 180 is fed from memory 70, as will be described below. The output of glass breakage decision module 180 is fed to output module 60. The output of output module 60 is in one embodiment fed to an alarm system 65.

Figure 2B:
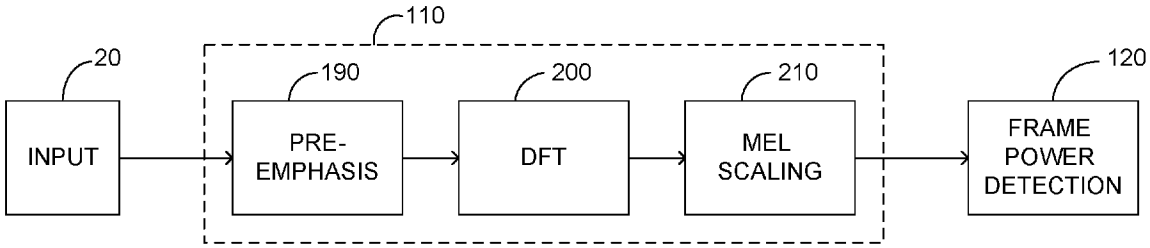
FIGS. 2B-2F illustrate non-limiting detailed embodiments of various parts of the glass breakage detection system of FIG. 2A.

As illustrated in FIG. 2B, in one embodiment, power spectrum module 110 comprises: a pre-emphasis module 190; a discrete fourier transform (DFT) module 200; and a Mel scaling module 210. Each of pre-emphasis module 190, DFT module 200 and Mel scaling module 210 may be implemented in application specific hardware, or in software run on the appropriate processor, with instructions stored in memory 70. The input of power spectrum module 110 is fed to pre-emphasis module 190 and the output of pre-emphasis module 190 is fed to DFT module 200. The output of DFT module 200 is fed to Mel scaling module 210 and the output of Mel scaling module 210 is fed to frame power detection module 120.

Figure 2C:
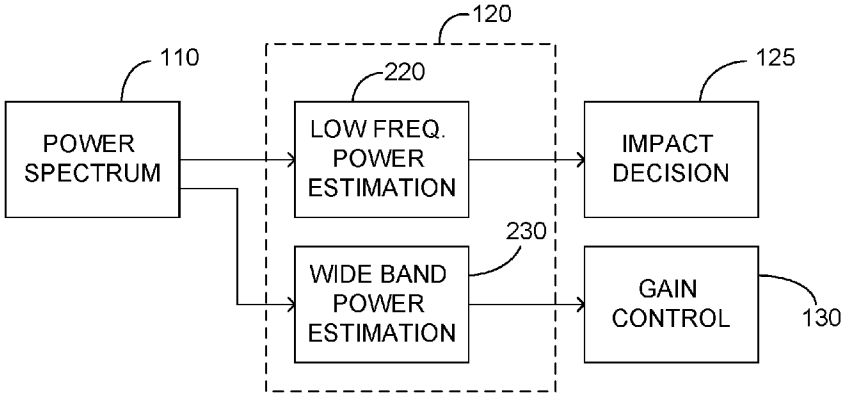

As illustrated in FIG. 2C, frame power detection module 120 comprises: a low frequency power estimation module 220; and a wide band power estimation module 230. Each of low frequency power estimation module 220 and wide band power estimation module 230 may be implemented in application specific hardware, or in software run on the appropriate processor, with instructions stored in memory 70. The input of frame power detection module 120 is fed to low frequency power estimation module 220 and to wide band power estimation module 230. The output of low frequency power estimation module 220 is fed to impact decision module 125. The output of wide band power estimation module 230 is fed to gain control module 130.

Figure 2D:
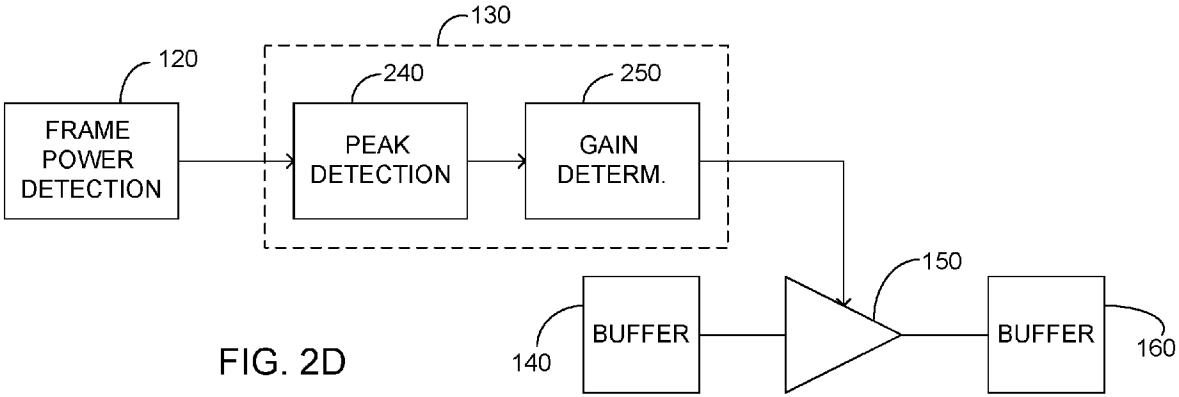

As illustrated in FIG. 2D, gain control module 130 comprises: a peak detection module 240; and a gain determination module 250. The input of gain control module 130, i.e. the output of wind band power estimation module 230, is fed to peak detection module 240. The output of peak detection module 240 is fed to gain determination module 250 and the output of gain determination module 250 is fed to a control input of amplifier 150.

Figure 2E:
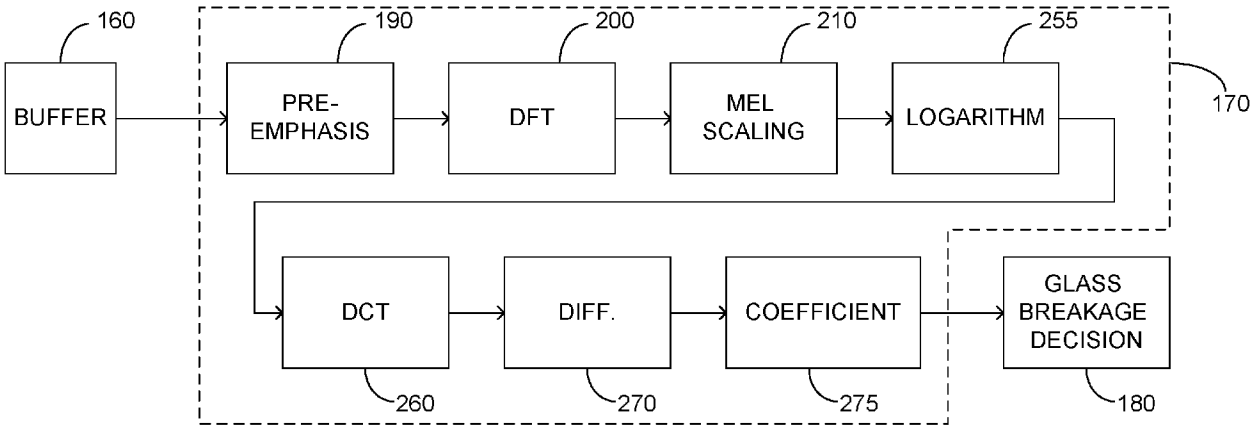

As illustrated in FIG. 2E, power spectrum module 170 comprises: a pre-emphasis module 190; a discrete Fourier transform (DFT) module 200; a Mel scaling module 210; a logarithm module 255; a discrete Cosine transform (DCT) module 260; a differentiation module 270; and a coefficient module 275. Each of logarithm module 255, DCT module 260, differentiation module 270 and coefficient module 275 may be implemented in application specific hardware, or in software run on the appropriate processor, with instructions stored in memory 70. The input of power spectrum module 170 is fed to pre-emphasis module 190 and the output of pre-emphasis module 190 is fed to DFT module 200. The output of DFT module 200 is fed to Mel scaling module 210 and the output of Mel scaling module 210 is fed to logarithm module 255. The output of logarithm module 255 is fed to DCT module 260. The output of DCT module 260 is fed to differentiation module 270 and to a first input of coefficient module 275. The output of differentiation module 270 is fed to a second input of coefficient module 275. The output of coefficient module 275 is fed to the output of power spectrum module 170 and the output of power spectrum module 170 is fed to glass breakage decision module 180.

Figure 2F:
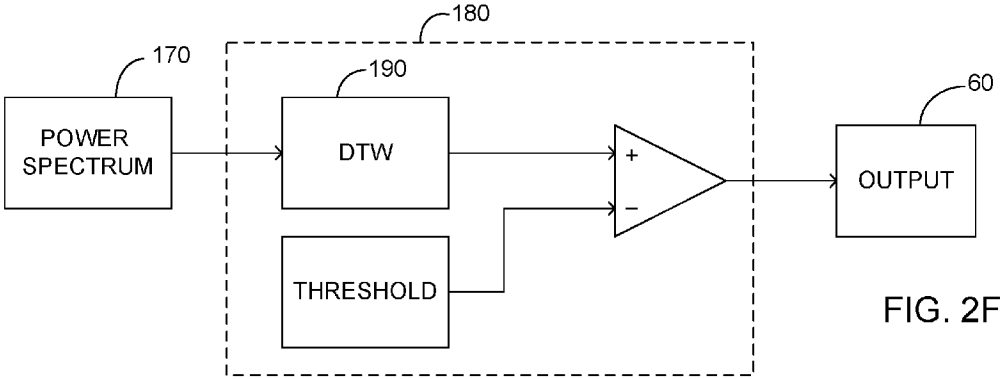

As illustrated in FIG. 2F, glass breakage decision module 180 comprises: a dynamic time warping (DTW) module 280; a cost threshold module 290; and a comparison module 300. Each of DTW module 280, threshold module 290 and comparison module 300 may be implemented in application specific hardware, or in software run on the appropriate processor, with instructions stored in memory 70. The outputs of first and second power spectrum modules 170 are fed to DTW module 280 and the output of DTW module 280 is fed to a first input of comparison module 300. A second input of comparison module 300 is fed from the output of threshold module 290.

In operation, input module 20 is arranged to receive audio data from a microphone 80. Input module 20 is arranged to sample the audio data received from microphone 80 at a predetermined sampling rate. In one embodiment, input module 20 is further arranged to filter out unwanted noise. The sampled audio data is output to power spectrum module 110 and is further output to buffer 140. Pre-emphasis module 190 of power spectrum module 110 is arranged to filter the received audio data to amplify the higher frequencies of the data. A non-limiting example of a filter frequency response of pre-emphasis module 190, with a sampling rate of 8000 Hertz, is illustrated by curve 310 in a graph of FIG. 2E, where the x-axis represents frequency in kilo-Hertz (KHz) and the y-axis represents gain in decibels (dB). As shown in curve 310, frequencies above 1.5 KHz are amplified and frequencies below 1.5 KHz are attenuated.

The filtered audio data is transformed to the frequency domain by DFT module 200, utilizing a DFT, and separated into equally spaced frequency bands. Particularly, prior to the transform, the audio data is split into sample frames, with each frame consisting of 8 milliseconds of audio data. The sample frames are then overlapped. Specifically, the samples of each frame are concatenated with the samples of the previous frame. The overlapped frames are then windowed, optionally with a Hamming window. The windowed overlapped frames are then transformed to the frequency domain utilizing a DFT, optionally producing 63 equally spaced frequency bands. Mel scaling module 210 is arranged to multiply the frequency bands of DFT module 200 with a predetermined matrix to create 26 Mel-spaced band power values.

The Mel-spaced band power values are received by frame power detection module 120. Frame power detection module 120 is arranged to determine the sound power over each frame period, i.e. 8 milliseconds in the example described above. Particularly, low frequency power estimation module 220 is arranged to estimate the sound power in lower frequencies and wide band power estimation module 230 is arranged to estimate the sound power over a wide frequency band. In one embodiment, wide band power estimation module 230 is arranged to determine a sum of the Mel-space band power values for each frame. Furthermore, low frequency power estimation module 220 is arranged to determine a weighted sum of the lower Mel-space band power values for each frame. In one embodiment, one of a high sensitivity and a low sensitivity setting can be used for low frequency power estimation module 220, optionally responsive to a user input. In one further embodiment, the high sensitivity low frequency power estimation is determined as:

$$P_{LF}(i)=P_{MB}(i,0)+P_{MB}(i,1)+P_{MB}(i,2)+2*P_{MB}(i,3)+2*P_{MB}(i,4)+0.5*P_{MB}(i,5) \quad \text{EQ. 1}$$

and the low sensitivity low frequency power estimation is determined as:

$$P_{LF}(i)=0.125*P_{MB}(i,0)+0.125*P_{MB}(i,1)+0.125*P_{MB}(i,3) \quad \text{EQ. 2}$$

where $P_{LF}$ is the low frequency power estimation array, i is the index of each frame period and $P_{MB}$ is the Mel-space band power value array for each frame period.

Impact decision module 125 is arranged to compare the output of low frequency power estimation module 220 for each frame with a predetermined threshold value. As described above, there are a plurality of settings for the sensitivity of low frequency power estimation module 220. When the high sensitivity is selected, the probability of the low frequency power estimation being greater than the threshold value increases, thereby reducing the chance of missing a breaking glass sound while increasing the chance of detecting a false positive. When the low sensitivity is selected, the probability of the low frequency power estimation being greater than the threshold value decreases, thereby reducing the chance of detecting a false positive while increasing the chance of missing a breaking glass sound. In the event that the low frequency power estimation is greater than the threshold value for at least a predetermined number of frames, optionally 2 out of 20 consecutive frames of a 1.6 second time period, impact decision module 125 asserts an impact detection signal indicating that an impact on glass has been detected. Particularly, the initial percussive burst of the glass breaking has significant low frequency energy that is fast decaying compared to higher portions of the sound spectra. This decay and frequency signature is recognized by the above described method of frame power detection module 120 and impact decision module 125.

Responsive to the output impact detection signal, buffer 140 is arranged to feed a predetermined number of samples to amplifier 150, optionally the samples from a time period of 1.6 seconds, and buffer 160 is arranged to feed the amplified samples to power spectrum module 170 for analyses. Advantageously, analyzing whether glass has been broken occurs only when an impact on glass has been identified, increases the accuracy of detection. Additionally, the samples are amplified appropriately to increase the quality of detection, as will be described herein.

Peak detection module 240 is arranged to determine the highest value in the wide band power estimation array, i.e. from the frame exhibiting the highest power sum. Gain determination module 250 is arranged to compare the value determined by peak detection module 240 with a lookup table stored on memory 70 to determine the appropriate gain for amplifier 150. An non-limiting embodiment of such a lookup table is as follows:

TABLE 1

| Range of Peak | Gain |
|---|---|
| >=2048.0 | 0.50 |
| [1024.0 2048.0) | 0.75 |
| [512.0 1024.0) | 1.00 |
| [256.0 512.0) | 1.50 |
| [128.0 256.0) | 2.00 |
| [64.0 128.0) | 2.75 |
| [32.0 64.0) | 4.00 |
| [16.0 32.0) | 5.75 |
| [8.0 16.0) | 8.00 |
| [4.0 8.0) | 11.25 |
| [2.0 4.0) | 16.00 |
| [1.0 2.0) | 22.50 |
| [0.5 1.0) | 32.00 |
| [0.25 0.5) | 45.25 |
| <0.25 | 64.00 |

For example, if the frame with the highest power sum, as determined by wide band power estimation module 230, exhibits a power sum of 6.0, gain determination module 250 is arranged to adjust the gain of amplifier 150 to a value of 11.25.

The amplified samples are fed to first power spectrum module 170, via buffer 160 which is arranged to receive the amplified samples of the predetermined time period. First power spectrum module 170 is arranged to determine Mel-frequency cepstral coefficients (MFCCs) of the amplified samples. Specifically, in one embodiment, pre-emphasis module 190 is arranged to emphasize the higher frequencies of the amplified samples, as described above. DFT module 200 is arranged to transform the emphasized samples to the frequency domain and Mel scaling module 210 is arranged to scale the frequency bands to Mel-spaced frequency band power values, as described above. Logarithm module 255 is arranged to determine a logarithm of the Mel-spaced frequency band power values and a DCT is applied to the outcome by DCT module 260, thereby deriving Cepstrum values. In one embodiment, 8 Cepstrum values are derived from 26 Mel-spaced frequency band power values of Mel scaling module 210. The Cepstrum values are fed to coefficient module 275 and are additionally fed to differentiation module 270. Differentiation module 270 is arranged to determine the rate of change over time, from frame to frame, of each the Cepstrum values. In one embodiment, differentiation module 270 is arranged to apply a digital filter which approximates the operation of a differentiator by utilizing a difference equation. In one non-limiting embodiment, the difference equation is as follows:

$$dc(i,k)=0.0667*c(i-4,k)+0.0500*c(i-3,k)+0.0333*c(i-2,k)+0.0167*c(i-1,k)-0.0167*c(i+1,k)-0.0333*c(i-3,k)-0.0500*c(i+3,k)-0.0667*c(i+4,k) \quad \text{EQ. 3}$$

where i is the frame index, k is the Cepstrum value index such that c is the array of Cepstrum values for each frame.

Coefficient module 275 is arranged to concatenate, for each frame, the Cepstrum values with the differential values output by differentiation module 270, thereby deriving MFCCs. Memory 70 has stored thereon MFCC templates, i.e. precomputed sets of MFCCs which are generated, as described above, from sounds representing breaking glass. Glass breakage decision module 180 is arranged to compare the MFCCs received from coefficient module 175 with the MFCCs stored on memory 70. In one embodiment, a 1.6 second set of MFCCs are compared one by one to eight precomputed sets of MFCCs stored on memory 70.

Specifically, in one embodiment, DTW module 280 is arranged to compare the MFCCs utilizing a dynamic time warping algorithm. In one non-limiting embodiment, the DTW algorithm implements a comparison of two matrices and outputs a scalar positive value which is lower when the two input matrices are similar. One non-limiting example of 'C' code is described below.

Threshold module 290 has stored thereon predetermined thresholds for comparisons of MFCCs with the MFCCs stored on memory 70. For each comparison of DTW module 280, comparison module 300 is arranged to compare the value output by DTW module 280 with the respective predetermined threshold. In the event that at least one of the values is less than the respective predetermined threshold, glass breakage decision module 180 is arranged to output to output module 60 a signal indicating that glass has been broken. Output module 60 is arranged to output the indication to an external network and/or to alarm system 65. In one embodiment, the thresholds stored on threshold module 290 are adjustable for different sensitivity setting, in accordance with stored statistical analysis data, the sensitivity settings optionally responsive to a user input at a user sensitivity input device.

In one embodiment, glass breakage detection system 100 is set to detect breakage of laminated glass, which produces a significantly different sound than regular glass. Unique MFCCs for laminated glass are stored on memory 70 and the above method is similarly utilized for detection of laminated glass breakage and differentiating the sound of breaking laminated glass from other sounds, such as slamming doors or other household impacts.

Figure 3A:
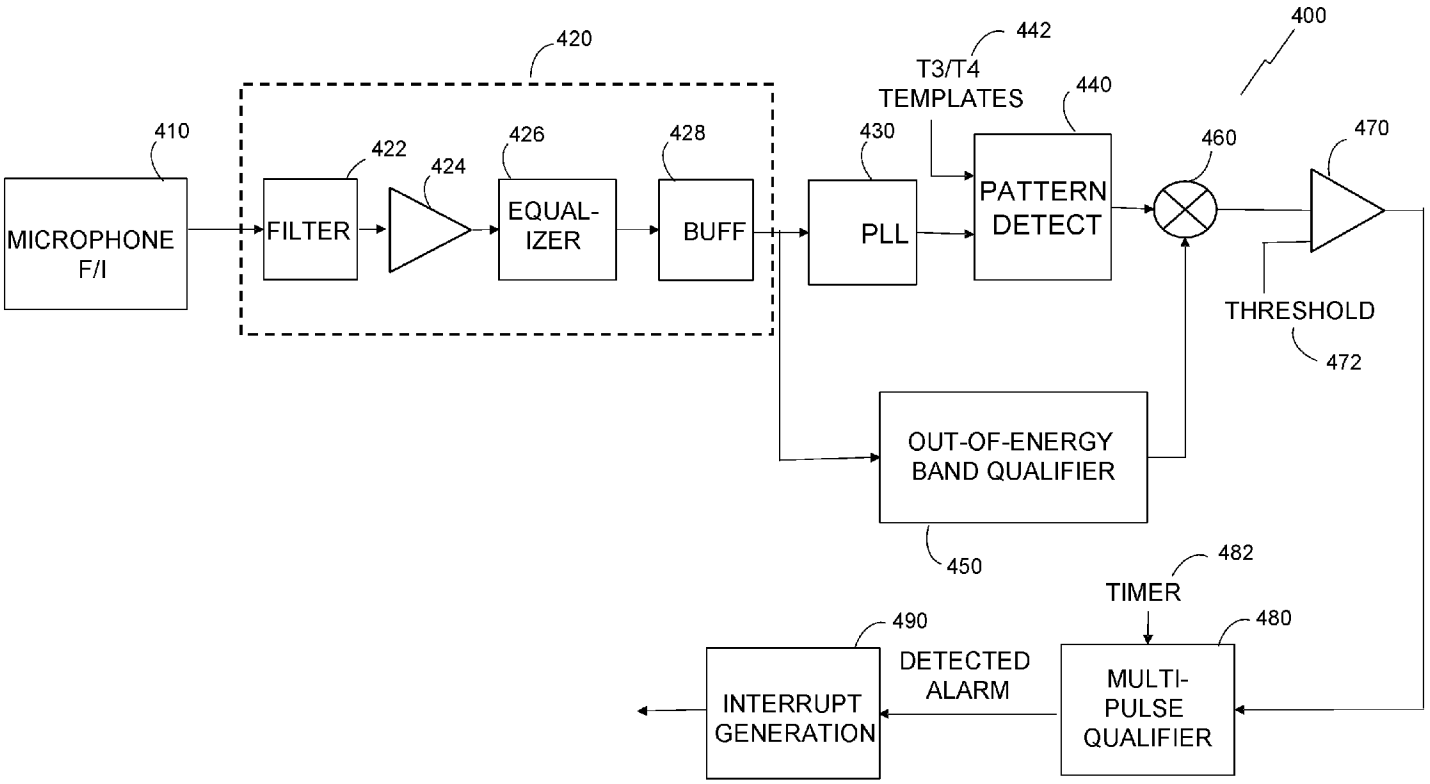
FIG. 3A illustrates a high level block diagram of an audible alarm detector, in accordance with certain embodiments.

FIG. 3A illustrates a high level block diagram showing the top level functionality of an audible alarm detector 400 in accordance with certain embodiments. Audible alarm detector is in all respects similar to audible alarm detector 100 described in U.S. patent application Ser. No. 15/203,819 filed Jul. 7, 2016 and entitled "ACOUSTIC ALARM DETECTOR", the entire contents of which are incorporated herein by reference. The detector 400 comprises a microphone interface 410 which detects an audible alert signal, as well as other ambient sounds. These audible alert signals can comprise an industry standard T3 pulse stream emitted by a smoke/fire detector and an industry standard T4 pulse stream emitted by a carbon monoxide alarm. The T3/T4 alarm may be of the older 3100 Hz sine wave alarm or the newer 520 Hz square wave alarm. The microphone interface 410 converts the sensed acoustic energy from the audible alert signals into electromagnetic energy. The microphone interface can include a digital microphone which can comprise an analog-to-digital converter. The invention is not limited to digital microphones, however, and an analog microphone could also be implemented. An analog-to-digital converter would preferably be provided to convert the audible alert signal into a digital signal. The detected signal is preferably sampled at 8 KHz or 16 KHz for conversion into a digital signal. Next the digital signal outputted from the microphone interface 410 is input into front end signal conditioning block 420. The front end signal conditioning block 420 removes constant (i.e. DC) and low frequency components from the digital signal. The front end signal conditioning block 20 also levels the frequency response and amplifies the digital signal. The front end signal conditioning block 420 can comprise, but is not limited to, filters such as high-pass filters 422 for removing DC and low frequency components. The front end signal conditioning block 420 can also comprise amplifier 424 for signal amplification. The amplified signal can then be passed through an equalizer 426 to stabilize or flatten the frequency response. The equalized signal is then stored in buffer 428. The conditioned digital signal is then output from the front end signal conditioning block 420 and input to digital phase-locked loop (PLL) 430. The PLL 430 is used for pulse demodulation. The PLL 430 locks onto the largest fundamental frequency present within either the 520 Hz or 3100 Hz band which simplifies frequency tuning compared to other methods such as using filter banks or Fast Fourier Transform (FFT). Since each PLL will lock onto a particular frequency, at least two PLLs would be required for the detection of 520 HZ and the 3100 Hz carrier frequencies. The T3 and T4 signals each have a carrier frequency of 3100 Hz which can vary by +/−10%. Similarly, at 520 Hz, the carrier frequency can vary by +/−10%. As such, the PLL must be able to lock to those range frequencies. The largest fundamental frequency corresponds to the frequency having the strongest signal strength or amplitude. The output of the PLL 130 is the baseband demodulated pulse corresponding to the envelope of the in band modulated signal. According to an embodiment of the invention, the PLL 430 uses continuous frequency domain sampling for demodulating the 520 Hz or 3100 Hz carrier frequency which avoids sampling tied to expected input duration. This is in contrast to certain prior art systems such as the discrete sampling in the Fast Fourier transform (FFT) method used in U.S. Pat. No. 7,015,807 where quantization errors and aliasing may be of concern. Furthermore, the use of a PLL, in place of FFT is advantageous since demodulation is performed without requiring any a-priori information since the PLL 430 locks onto the fundamental frequency having the strongest signal strength. After demodulation, the signal is input into pattern detector 440. In the pattern detector 440, the demodulated pulse output from the PLL 430 is decoded to determine if the target T3 and/or T4 pulse stream exists. Detection of the target T3 and/or T4 pulse stream is performed by correlation against a known set of templates of the T3/T4 pulse streams 442. In some embodiments of the present invention, pattern detection can be achieved using a correlator such as a matched filter. The pattern detector 440 is not limited to a correlator, and other implementations may be used. In the present embodiment, the set of T3/T4 templates 442 are stored in on-chip memory (not shown). In other embodiments, an external memory may be used to store a wider array of templates. The output of the pattern detector 440 is a matching score which is a numerical representation of the strength of the match between the output of the PLL 430 and the T3/T4 templates.

In some cases, a rich signal (often music or a similarly pulsed non T3 alarm) can cause a false positive detection. To keep those situations from causing a false trigger, the energy out of band may be tested in accordance with an embodiment of the invention. In this embodiment, the signal power including the total power and the power in the desired band (3100 Hz and/or 520 Hz) is monitored in parallel to the PLL 430 and pattern detector 440 by out-of-band energy qualifier 450. A wideband-to-narrowband ratio is determined and output from out-of-band energy qualifier 450. The ratio represents a value between 0 and 1 and is used to adjust the output of the pattern detector 440. In a situation where there is little wideband noise, the output of out-of-band energy qualifier 450 will be closer to 1. Conversely, in a situation where a lot of wideband noise is present, the output of out-of-band energy qualifier 450 will be closer to 0 and thus will significantly lower the matching score output from pattern detector 440. This has the effect of requiring the detected signal to be very exact if there is a lot of out of band noise. The output of the out-of-band energy qualifier 450 is input into multiplier 460 along with the output of the pattern detector 440. The output of multiplier 460 represents an adjusted output of the pattern detector in view of background noise or a non T3/T4 alarm.

The output of multiplier 460 is input into comparator 470. The comparator 470 compares the output of the pattern detector 440 with a threshold value 472 to qualify the result of the pattern detector 440. If the output of the pattern detector 440 meets and/or exceeds the threshold value 472, the audible alert signal detected by microphone interface 410 is determined to be an actual T3/T4 pulse stream and the comparator 470 outputs an active high signal. However, if the output of the pattern detector 440 is lower than the threshold value 472, the audible alert signal is determined not to be a T3/T4 pulse stream and the comparator 470 outputs an active low signal.

In certain embodiments, after a single T3/T4 alarm period is detected at the output of comparator 470 by an active high signal, the alarm can be further qualified by checking if subsequent alarms are present by multi-pulse qualifier 480. For example, in some embodiments of the invention, N audible alarms must be detected within a predetermined time window determined by timer 482 before outputting an alarm detected signal. In the event that only a single alarm period is detected, with no subsequent alarm period within the predetermined time window, the multi-pulse qualifier 480 does not assert an alarm detected signal. This adds to the general robustness of the alarm detection accuracy. This process looks to see if more than a predetermined number of frames in a given interval resulted in assertion of an active high signal by comparator 470. Since the output of the pattern detector 440, before comparator 470, is a score corresponding to the probability a T3/T4 alarm was detected, these scores may be summed over time to provide a continuous multiple pulse qualification. If so, the host/user is alerted that a T3/T4 alarm was detected responsive to an output alarm detected signal from the multi-pulse qualifier 480. In block 490, an interrupt or a notification is generated and output, responsive to output alarm detected signal from the multi-pulse qualifier 480, preferably to a host system so that an action can be taken. The interrupt or notification is thus generated responsive to the asserted signal at the output of comparator 470. In certain embodiments neither multi-pulse qualifier 480 nor out-of band energy qualifier 450 are provided. Alternately, in other embodiments, the output of pattern detector 440, appropriately buffered or amplified if required, is used as the interrupt or notification output, without requiring comparator 470, or multi-pulse qualifier 480.

Figure 3B:
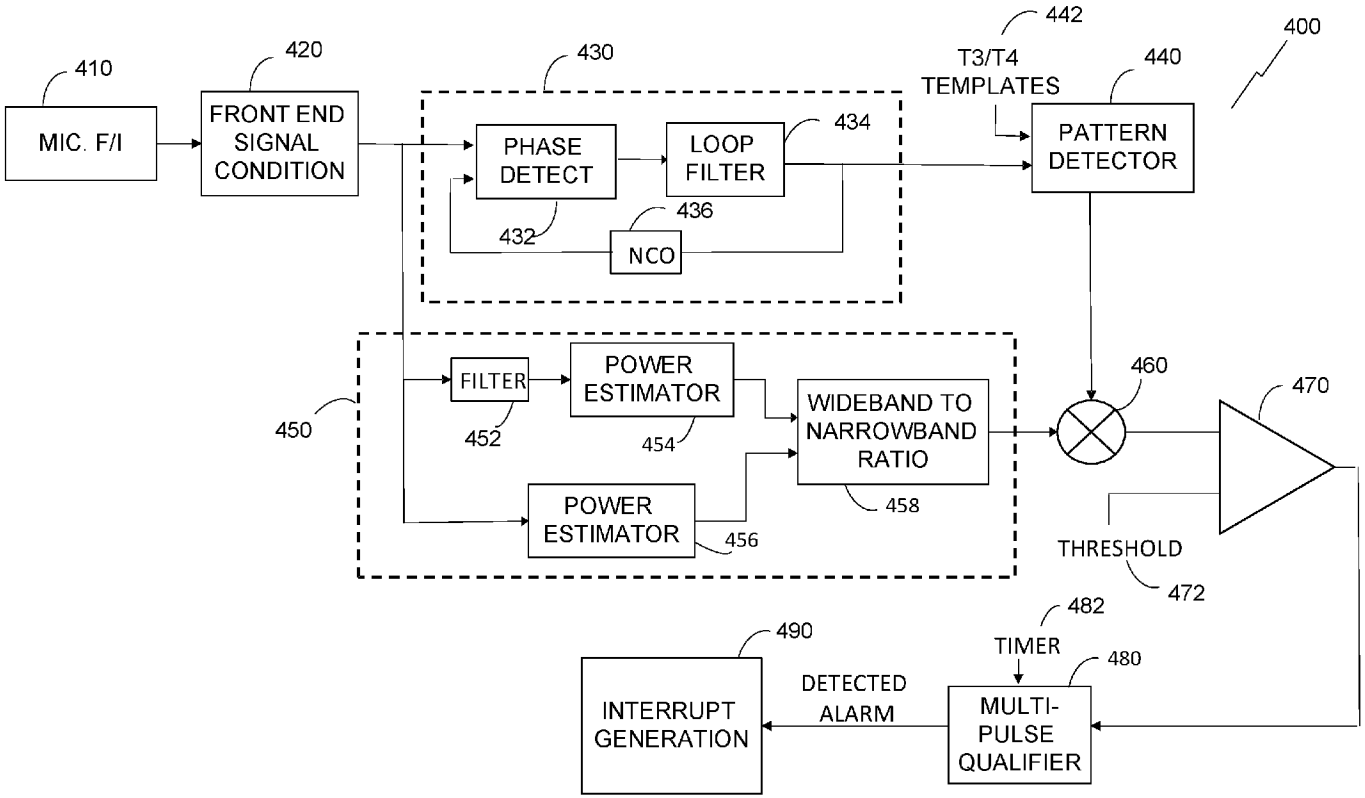
FIG. 3B illustrates a high level block diagram of the audible alarm detector of FIG. 3A showing details of an embodiment of a phase-locked loop and an embodiment of an out-of-band energy qualifier.

FIG. 3B illustrates a high level block diagram of detector 400 with details of the PLL 430 and out-of-band energy qualifier 450. Microphone interface 410 is connected to front end signal conditioning block 420, the details of which are shown in FIG. 3A. The conditioned signal then is input to PLL 430 and out-of-band energy qualifier 450. The structure of the PLL 430 generally comprises a phase detector 432, a loop filter 434 and an oscillator 436, such as a numerically-controlled oscillator (NCO) or a voltage-controlled oscillator. Other oscillator configurations can also be implemented. The conditioned signal is input into the phase detector 432 along with the feedback from the oscillator 436. The phase detector can be thought of as a multiplier, such that the output of the phase detector contains both sum and difference frequency components. The loop filter 434 removes the high frequency components and the output from the loop filter 434 is the demodulated signal. This demodulated signal output from loop filter 434 is then fed into pattern detector 440. In parallel to the PLL, the out-of-band energy qualifier 450 functions to qualify the detected audible alert signal to avoid false positive detection of the T3/T4 stream due to background noise or a non T3/T4 alarm. Out-of-band energy qualifier comprises filter 452, which is generally a band-pass filter to narrow the band of interest which can either be the 520 Hz band or the 3100 Hz band. Power estimator 454 is then used to determine the power of the band of interest. Concurrently, power estimator 456 is used to determine a total power of the entire frequency band of the conditioned signal which corresponds generally to the frequency band of the detected audible alert signal. In block 458, the wideband-to-narrowband ratio of the output of power estimator 454 (power of the band of interest, or narrowband) to the output of power estimator 456 (power of entire spectrum of detected audible alert signal) is determined. The result is a value which ranges between 0 and 1 and is used as an input to multiplier 460 to adjust the output or matching score of the pattern detector 440 as described above.

Figure 4:
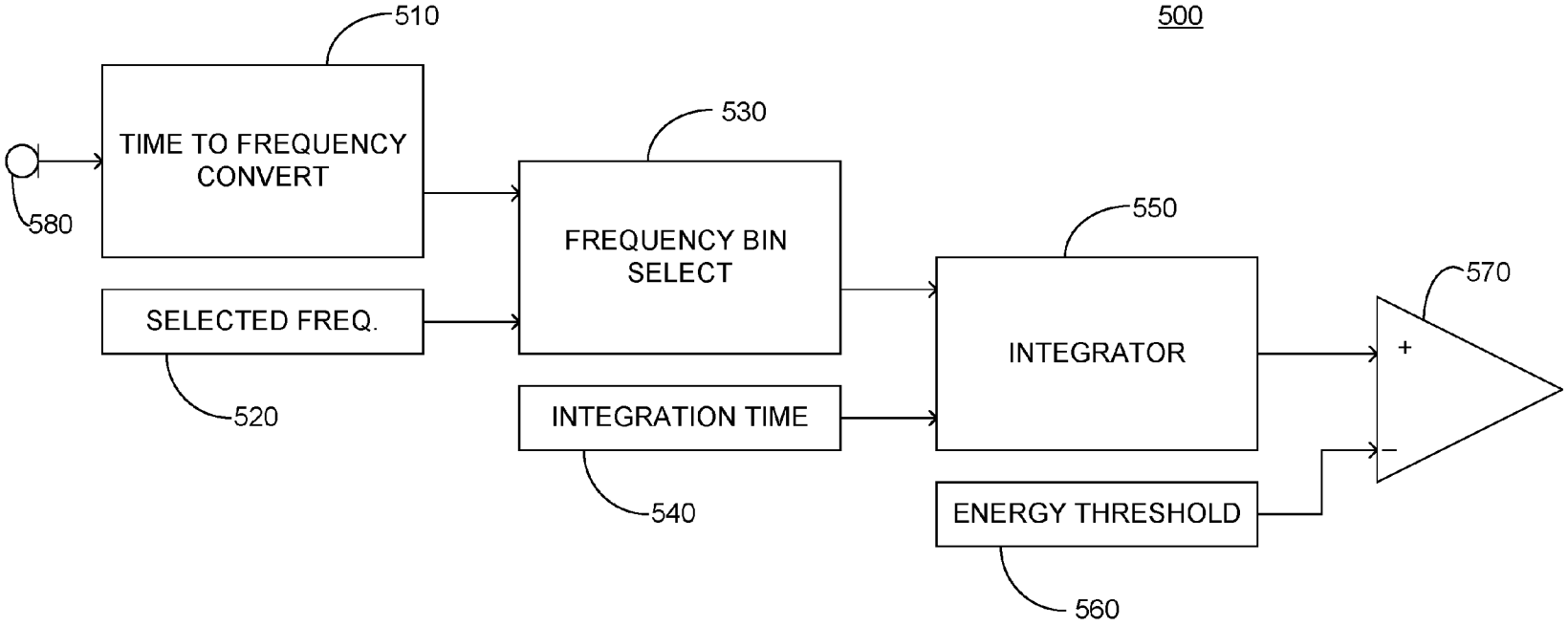
FIG. 4 illustrates a high level block diagram of a programmable energy detector, according to certain embodiments.

FIG. 4 illustrates a high level block diagram of a programmable energy detector 500 which allows the user to specify a specific sound signature to be detected. Programmable energy detector comprises: a time to frequency conversion module 510; a selected frequencies module 520; a frequency bin selection module 530; an integration time module 540; an integrator 550; an energy threshold module 560; and a comparator 570. Time to frequency conversion module 510 is fed from an output of a microphone 580 and the output of time to frequency conversion module 510 is fed to frequency bin selection module 530. The output of selected frequencies module 520 is also fed to frequency bin selection module 530 and the output of frequency bin selection module 530 is fed to integrator 550. The output of integration time module 540 is also fed to integrator 550 and the output of integrator 550 is fed to a first input of comparator 570. The output of energy threshold module 560 is fed to a second input of comparator 570.

Here, three user definable parameters, frequency bins, time duration, and magnitude threshold are set to qualify the acoustic input signal. The time domain signal is first converted to a collection of frequency bins in the frequency domain, via time to frequency conversion module 510 and frequency bin selection module 530. Responsive to a user input, selected frequencies module 520 selects which bins which are typically contiguous to look at, frequency bin selection module 530 ignoring the ones not selected. The bins are then combined-summed or sum squared- and averaged over a user defined time window at integrator 530, the user defined time window stored on integration time module 540 and integrator 530 is responsive thereto. The resulting output energy is compared, by comparator 570, against a preset threshold output by energy threshold module 560. Should the energy in the selected bins be high enough so that the average energy over the specified time interval is greater than the threshold, the energy detector signals a positive indication, at the output of comparator 570. This detector can be set for broadband noise detection or single tone detection and can catch short time window or persistent signals.

Figure 5A:
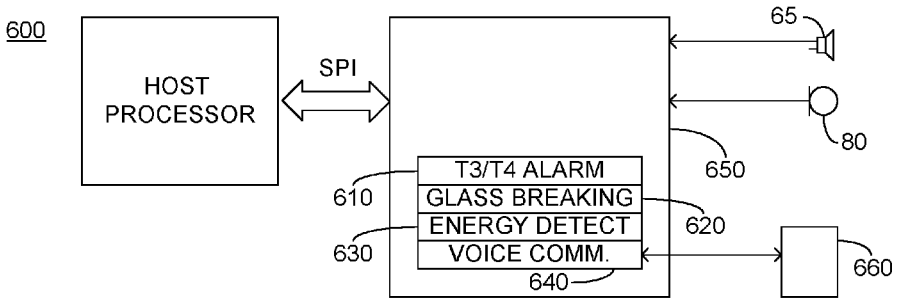
FIGS. 5A-5C illustrate high level block diagrams of a multi-purpose alarm system, according to certain embodiments.
Figure 5B:
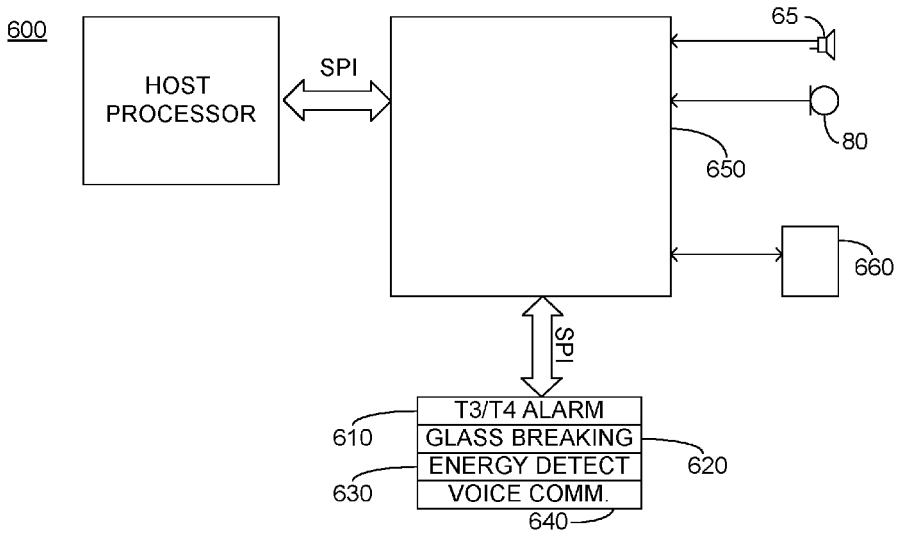
Figure 5C:
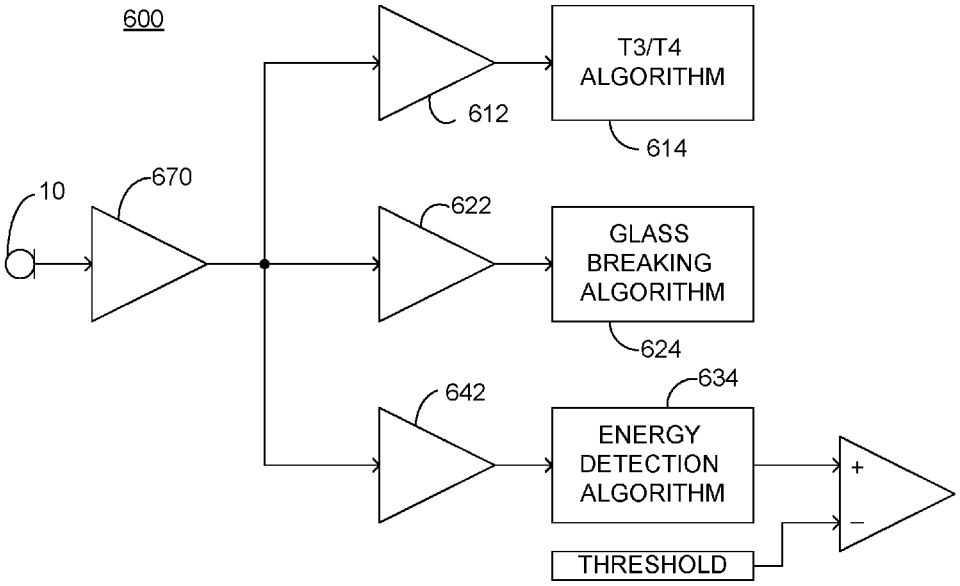

FIG. 5A illustrates a high level block diagram of a first embodiment of a multi-purpose alarm system 600, FIG. 5B illustrates a high level block diagram of a second embodiment of multi-purpose alarm system 600 and FIG. 5C illustrates a high level block diagram of a more detailed embodiment of a portion of multi-purpose alarm system 600, FIGS. 5A-5C being described together. Multi-purpose alarm system 600 comprises: a T3/T4 alarm detection module 610; a glass breakage detection module 620; an energy detection module 630; and a voice communication module 640. As illustrated in FIG. 5C, T3/T4 alarm detection module 610 comprises: a T3/T4 alarm detection algorithm unit 612; and a T3/T4 alarm detection amplifier 614. Glass breakage detection module 620 comprises: a glass breakage detection algorithm unit 622; and a glass breakage detection amplifier 614. Energy detection module 630 comprises: an energy detection algorithm unit 632; and an energy detection amplifier 634.

T3/T4 alarm detection algorithm unit 612 is implemented as described above in relation to audible alarm detector 400. Glass breakage detection algorithm unit 622 is implemented as described above in relation to glass breakage detection systems 10 and 100. Energy detection algorithm unit 632 is implemented as described above in relation to programmable energy detector 500. Voice communication module 640 is implemented as a voice over internet protocol (VoIP) communications system arranged to provide full duplex two-way voice communication via a communications device, such as a desktop speaker phone.

T3/T4 alarm detection module 610, glass breakage detection module 620, energy detection module 630 and voice communication module 640 are integrated onto a single chip 650. Each of T3/T4 alarm detection module 610, glass breakage detection module 620, energy detection module 630 and voice communication module 640 may be enabled or disabled by programmable configuration registers accessible by an external host device or user interface.

In one embodiment, the firmware for each of T3/T4 alarm detection module 610, glass breakage detection module 620, energy detection module 630 and voice communication module 640 are stored individually in memory which is either integrated into chip 650, as illustrated in FIG. 5A, or which is externally accessible to chip 650 via interfaces such as the Serial Peripheral Interface (SPI). The firmware blocks of T3/T4 alarm detection module 610, glass breakage detection module 620, energy detection module 630 and voice communication module 640 may be swapped in or out of chip 650 and enabled on an as-needed basis, on a memory space permissive basis, a power consumption minimization basis, or any combination thereof. Chip 650 is in one embodiment in communication with a host processor via an SPI and is further in communication with a microphone 80, and alarm 65 and a communications device 660. Microphone 80 is arranged to detect glass breakage sounds, T3 and T4 alarm sounds and for other various sounds, as described above, and alarm 65 is arranged to output an alert sound when any of the T3/T4 alarm detection module 610, glass breakage detection module 620 and energy detection module 630 detect a sound which triggers an alarm signal. Voice communication module 640 is arranged to provide voice communication via communications device 660. For example, after detection of glass breakage or a T3 or T4 alarm, an operator can call communications device, via voice communication module 640 to check if everything is all right.

In operation, sounds are received by microphone 80 and sampled and amplified by an input module 670. The output samples from input module 670 are then amplified separately by each of T3/T4 alarm detection amplifier 614, glass breakage detection amplifier 624 and energy detection amplifier 634. Each of T3/T4 alarm detection amplifier 614, glass breakage detection amplifier 624 and energy detection amplifier 634 exhibits a different gain value in accordance with the respective algorithm. The amplified audio samples are then respectively analyzed by T3/T4 alarm detection algorithm unit 612, glass breakage detection algorithm unit 622 and energy detection algorithm unit 632 to detect the relevant sounds and output an alarm signal to alarm 65 as needed.

Non-limiting example of code for DTW module 280 and threshold module 290

```
/*****************************************************************
* Function dtw
*
* Description:   calculates minimum distance thru the distance
*       matrix SM (SM hold the distance between
*       matrices c and r) using a dynamic time warping
*       algorithm. The element SM(n, m) of the large
*       matrix SM(N, M) are never stored but recomputed
*       as needed
*
* Inputs:
* c:   matrix of MFCC coefficients of samples input signal
* r:   matrix of MFCC coefficients of recorded reference signal
*          !! Note c and r subscripts below
*             do not mean columns & rows
* Nc:   # of rows of c signal coefficient matrix
* Nr:   # of cols of r reference matrix
* Outputs:
* Dist:   unnormalized distance between input MFCCS and
*          reference MFCCs
* Variables:
* SM:   distance matrix between matrices c and r
* D:     accumulated distance (cost) matrix using costs of SM
*
* Formula for SM(i, j)
* -------------------
*       SM(i, j) = ci.*ci + rj.*rj − 2*ci.*rj    i=row j=col (frames)
*          = an(i) + bn(j) − 2*ci.*rj
*       where .* is vector dot product (16 MFCCs in each vector)
*
* Size of SM(i, j)
* -------------------
*          SM =   (ai ai + bj bj) − 2 (    c    *    r    )
*       rowsC × colsR = rowsC × colsR   rowsC × MFCCwid    *    MFCCwid × colsR
* e.g. (201 × 285)    =    (201 × 285)    (201 × 16) * (16 × 285)
*
*****************************************************************/
  uint16 dtw(    int16    c2[ ] [MFCC_WIDTH],
              int16    r[ ] [MAX_FRAMES],
              int    Nc,
              int    Nr)
{
     // output variable
  uint16 Dist;                          // unnormalized distance between input
                                        MFCCs and
                                        //    reference MFCCd
  // local variables
  int32    D_n_0[MAX_FRAMES];    // 1st col of accumulated distance matrix    Q26.6
  int32    D_0_m[MAX_FRAMES]     // 1st col of accumulated distance matrix    Q26.6
  int32    D_nm1    [MAX_FRAMES]; // row n-1 of accumulated distance matrix    Q26.6
  int32    D_n_m;                // D (n, m) present element of accumulated dist.
matrix Q26.6
  int32    D_n_mm1;              // D(n    ,m-1) prior path of accumulated distance
matrix Q26.6
  int32    D_nm1_mm1;            // D (n-1, m-1) prior path of accumulate distance
matrix Q26.6
  int32    D_nm1_m;              // D(n-1, m    ) prior path of accumulated distance
matrix Q26.6
  int    n;                      // row index
  int    m;                      // col index
  int 32    minPriorPathValue    // minimum value of cost from 3 possible paths
```

-continued

Non-limiting example of code for DTW module 280 and threshold module 290

```
// general variables
int i;                          // row or column index
int j;                          // row or column index
int32   acc;                    // accumlator
int32   acc2;                   // accumulator for sum of an and bn
// matrix diagonal calculation variables - These are stored, rather than
recalculated
int16   an[MAX_FRAMES];         // diag (c' *c)
int16   bn[MAX_FRAMES];         // diag (r' *r)
// matrix diagonal of c' * c where ' is transpose
acc2 = 0;
for (i = 0; i < Nc; i++)        // # frames (rows) of c
{
  acc = 0;
  for (j = 0; j < MFCC_WIDTH; j++)
  {
    int16   cTemp;
    cTemp = c2[i] [j];
    // Q10.22 = Q10.22   Q5.11 * Q5.11
    acc   =   acc   +   cTemp * cTemp; // accumulate c(i, j)^2
}
an[i] = acc >> 16; // Q10.22 --> Q10.6
// Q26.6   =   Q26.6   +   Q26.6
acc2   =   acc2   +   (int32) an[i];
}
// matrix diagonal of r' * r where ' is transpose
acc2 = 0;
for (i = 0; i < Nr; i++) // # frames (cols) of r
{
  acc = 0;
  for (j = 0; j < MFCC_WIDTH; j++)
  {
    int16   rTemp;
    rTemp = r[j] [i]
    // Q10.22 = Q10.22   Q5.11 * Q5.11
    acc   =   acc   + rTemp * rTemp;   // accumulate r(j, i)^2
  }
  bn[i] = acc >> 16; // Q10.22   -->   Q10.6
  // Q26.6   =   Q26.6   +   Q26.6
  acc2   =   acc2   +   (int32) bn[i];
}
// Intialize accumulated distance matrix in top corner cell
D_n_0[0] = SM_index(   c2, r, an, bn, 0, 0);
D_0_m[0] = D_n_0[0];
D_nm1[0] = D_0_m[0];
//   initialize first col of distance matrix to sum of values immediatly
//   adjacent as the only path is sideways
for (n = 1; n < Nc; n++)        // rows of D
{
    //   dist is current value plus downward distance to it
    D_n_0[n] =SM_index(   c2, r, an, bn, n, 0) + D_n_0[m-1];
}
// intialize first row of distance matriz to sum values immediatly
// adjacent as the only path is down
//   adjacent as the only path is down
for (m = 1; m < Nr; m++)        //cols of D
{
    // dist is current value plus sideways distance up to it
    D_0_m[m]=SM_index( c2, r, an, bn, n, 0) + D_0__m[m-1];
    D_nm1[m] = D_0_m[m];        // save 1st row as prior row
}
// Starting from the second cell, build the distance matrix up
//   by getting the minimum of the three directions to it
for (n = 1; n < Nc; n++)        // rows of D
{
    D_nm1_mm1 = D_n_0[n-1];   D(n-1, 0) --> D(n-1, m-1)
    D_n_mm1 = D_n_0[n];       D(n,   0) --> D(n,   m)
for (m = 1; m < Nr; m++)        // cols of D
{
      D_nm1_m = D_nm1[m]      // D(n-1, m) --> from stored row n-1
      // Determine min of three paths to adjacent to current cell (left, diag,
down)
      minPriorPathValue =   D_n_mm1;
      minPriorPathValue =   ( D_nm1_mm1 < minPriorPathValue) ? D_nm1_mm1 :
minPriorPathValue;
      minPriorPathValue = ( D_nm1_m   < minPriorPathValue) ? D_nm1_m :
minPriorPathValue;
```

-continued

Non-limiting example of code for DTW module 280 and threshold module 290

```
            // Distance is current cell value plus min of three paths to it
            D_n_m SM_index (   c2, r, an, bn, n, m) + minPriorPathValue;
            // Update state
            D_nm1_mm1 = D_nm1_m;  // D(n-1, m)   --> D(n-1, m-1)
            D_n_mm1 = D_n_m;      // D(n,   m-1)   --> D(n,   m)
            D_nm1[m] = D_n_m;     // store current row element for use as prior row
        }
    }
    // final distance (cost) is the last (bottom) entry in the matrix
    Dist = (uint16) (D_n_m>>6) ;          // Q26.6 --> Q16.0
    return Dist;
}
/*****************************************************************
* Function SM_index
*
* Description: calulates one distance value SM(row, col) of the
*          distance matrix SM
*
* Inputs:
* c:         matrix of MFCC coefficients of samples input signal
* r:         matrix of MFCC coefficients of recorded reference signal
* an:        power of frames (rows) of MFCCs in c
* bn:        power of frames (cols) of MFCCs in r
* row:       row index of SM element to calculate
* col:       col index of SM element to calculate
* Outputs:
* out:       value of SM(row, col)
*
*            SM      = (ai   ai   +   bj   bj) −2 (   c   *   r   )
    rowsC × colsR =    rowsC × colsR rowsC × MFCCwid * MFCCwid × colsR
* e.g.   (201 × 285) = (201 × 285)      (201 × 16)   *   (16 × 285)
*
* Matlab code
*    Ai2_plus_Bj2 = diag(c*c')*ones(1, Nr) + ones(Nc, 1) *diag(r' r*)
*    SM = Ai2_plus_Bj2 − 2*c*r;
*
*****************************************************************/
int16   SM_index(int16      c2[ ] [MFCC_WIDTH],
            int16   r[ ] [MAX FRAMES],
            int16   an[ ],
            int16   bn [ ],
            int     row,
            int     col)
{
        int16   out;
        int   k;                          // MFCC coeff index for each frame
*       int32   acc;                      // accumulator
*       // SM(i, j) = ci.*ci + rj.*rj − 2*ci.*rj   i=row j=col (frames)
        //       = an(i) + bn(j) − 2*ci.*rj
        //   where .* is vector dot product (16 MFCCs in each vector)
        acc = 0;
        for (k = 0; k < MFCC_WIDTH; k++)
        {
        int16   cTemp, rTemp;
        cTemp = c2[row][k]; // Q5.11
        rTemp = r[k] [col]; // Q5.11
        //Q10.22 = Q10.22 + Q5.11 * Q5.11
        acc   =   acc + cTemp * rTemp;
    }
    //   Q10.6 = Q10.6 + Q10.6 − 2.0 * (Q10.22>>16)
    out   = an [row] + bn[col] − (int16)(acc >> 15); // an(row) + bn(col) − 2.0 *
    acc
      return out;
    }
```

It should be appreciated by those skilled in the art that any block diagrams herein represent conceptual views of illustrative circuitry embodying the principles of the invention. For example, a processor may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. The functional blocks or modules illustrated herein may in practice be implemented in hardware or software running on a suitable processor.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

The invention claimed is:

1. A glass breakage detection method, the method comprising:

receiving a plurality of audio samples;

estimating low frequency power values of said received plurality of audio samples;

estimating wide band power values of said received plurality of audio samples;

responsive to said estimated wide band power values, determining an amplification value;

responsive to said estimated low frequency power being greater than a predetermined threshold, amplifying a function of said received plurality of audio samples by said determined amplification value;

comparing said amplified function with a predetermined function of sound of breaking glass; and outputting an indication of said comparison.

2. The method of claim 1, further comprising determining Mel-spaced band power values of said received plurality of audio samples, wherein low frequency power value estimation is responsive to said determined Mel-spaced band power values.

3. The method of claim 1, wherein said plurality of audio samples are received over a predetermined time period, wherein the method further comprises comparing said estimated low frequency power values of each of a plurality of portions of said predetermined time period with a predetermined threshold, and wherein said amplification is responsive to estimated low frequency power values being greater than the predetermined threshold for more than one of said plurality of time period portions.

4. An alarm system, comprising:

an input module arranged to:

receive audio data; and sample the received audio data at a predetermined sampling rate to produce a plurality of audio samples, an impact detection module arranged to:

estimate low frequency power values of said produced plurality of audio samples;

estimate wide band power values of said produced plurality of audio samples;

determine, responsive to said estimated wide band power values, an amplification value; and assert, responsive to said estimated low frequency power values being greater than a predetermined threshold, an impact detection signal, a gain module arranged to amplify a function of said produced plurality of audio samples by said determined amplification value responsive to assertion of said impact detection signal;

a glass breakage detection module responsive to an output of said gain module, said glass breakage detection module arranged to compare said amplified function of said produced plurality of audio samples with a predetermined function of sound of breaking glass; and an output module responsive to said glass breakage detection module arranged to output an indication of said comparison.

5. The alarm system according to claim 4, wherein said impact detection module is further arranged to determine Mel-spaced band power values of said produced plurality of audio samples, said low frequency power value estimation responsive to said determined Mel-spaced band power values.

6. The alarm system according to claim 4, wherein said plurality of audio samples are produced over a predetermined time period and wherein said impact detection module is further arranged to:

compare said estimated low frequency power values of each of a plurality of portions of said predetermined time period with a predetermined threshold; and wherein said assertion of said impact detection signal amplification is responsive to said compared estimated low frequency power values being greater than the predetermined threshold for more than one of said plurality of time period portions.

7. The alarm system according to claim 4, further comprising a T3/T4 detection module arranged to detect sounds of a T3 or T4 alarm within said produced audio samples, said output module further responsive to said T3/T4 detection module.

8. The alarm system according to claim 7, further comprising:

a programmable sound energy detection module arranged to detect various predetermined sounds within said produced plurality of audio samples; and a voice communication module arranged to provide two way communication between a communication device and a communication network, wherein each of said T3/T4 detection module, said glass breakage detection module and said programmable sound energy detection module comprise a unique amplifier arranged to amplify said received audio samples by a predetermined respective gain.

* * * * *